United States Patent [19]

McCaleb

[11] 4,319,517

[45] Mar. 16, 1982

[54] PISTON FILLER

[75] Inventor: David E. McCaleb, Minneapolis, Minn.

[73] Assignee: Liquipak International, Inc., St. Paul, Minn.

[21] Appl. No.: 160,518

[22] Filed: Jun. 18, 1980

[51] Int. Cl.[3] ..... F01B 29/00

[52] U.S. Cl. ..... 92/128; 141/258; 222/334

[58] Field of Search ..... 141/258; 222/333, 334, 222/309, 319, 372, 387, 388, 389; 60/593; 92/128, 146, 161; 417/360

[56] References Cited

U.S. PATENT DOCUMENTS

| | | | |
|---|---|---|---|
| 3,101,161 | 8/1963 | Ivarson | 222/334 |
| 3,227,325 | 1/1966 | Bates | 222/334 |
| 3,411,745 | 11/1968 | Austin et al. | |
| 3,693,640 | 9/1972 | Wettlen et al. | |
| 3,964,526 | 6/1976 | Sindermann . | |
| 4,207,807 | 6/1980 | Takata et al. | 92/128 |

*Primary Examiner*—H. Grant Skaggs

*Attorney, Agent, or Firm*—Schroeder, Siegfried, Vidas, Steffey & Arrett

[57] ABSTRACT

An improved fill piston and housing assembly for use in filling equipment is disclosed which comprises a piston disposed within an annular cavity formed by a clamped mating assembly of a mounting flange, spacer tube, guide bushing and a sealed metering cylinder section, which piston is demountably attached to an arm secured to the working means of the filling equipment by a T-shaped nut and slot.

1 Claim, 1 Drawing Figure

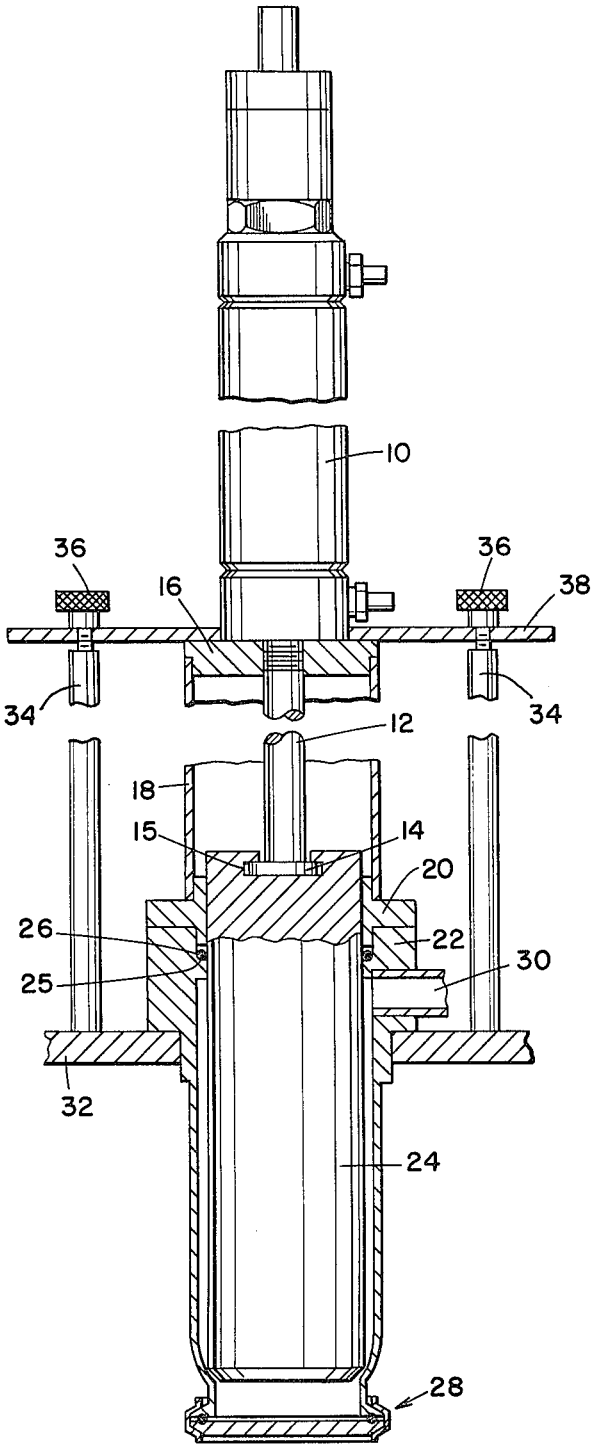
10
36
36
38
16
34
34
12
18
15
14
20
26
22
30
25
32
24
28

PISTON FILLER

SUMMARY OF THE INVENTION

The present invention relates to an improved fill piston and housing assembly for use in filling equipment. In particular, the present invention relates to an improved fill piston disposed within a housing assembly having an annular cavity formed by a clamped mating assembly of a mounting flange, spacer tube, guide bushing and a sealed metering cylinder section, which piston is demountably attached to an arm secured to the working means of the filling equipment by a T-shaped nut and slot.

BACKGROUND OF THE INVENTION

A great number of industrial applications require the continuous filling of containers with measured quantities of fluid. Metering devices designed for continuous operation have been known for some time, and the machinery used for these purposes is normally cleaned every day. This cleaning, particularly in food industries, typically involves the complete breakdown and reassembly of the machinery.

Various attempts have been made to provide machinery which could be conveniently broken down into its component pieces for cleaning. U.S. Pat. No. 3,227,325 provides a metering dispenser for plastic materials in which only the valve and metering cylinder must be removed for cleaning. Likewise, U.S. Pat. No. 3,411,745 shows a fill valve assembly which is intended to be simplified in construction for low cost and easier maintenance.

It is an object of the present invention to provide a fill piston and housing assembly for use in filling machinery.

It is a further object of the present invention to provide a fill piston and housing assembly for use in filling machinery which is a clamped mating assembly for ease in assembly and disassembly.

The objects, features, and advantages of the present invention are pointed out with particularity in the claims annexed to this specification. Further, they will become more apparent in light of the following detailed description of the preferred embodiment thereof and as illustrated in the accompanying drawing.

According to the present invention, there is provided an improved fill piston and housing assembly for attachment to the working means of filling equipment which comprises an arm having one end secured to the working means of the filling equipment and having a T-shaped connection at the opposite end; a mounting flange having one face secured to the filling equipment, having a hole therethrough to accommodate said arm and having a circular raised portion on its opposite face; a hollow cylindrical spacer tube having one end in mating engagement with the mounting flange and the raised portion thereof; a guide bushing having one face in mating engagement with the opposite end of the spacer tube and having an opening therethrough; a metering cylinder in mating engagement with the opposite face of the guide bushing but notched so as to provide an annular groove on the inside surface at their junction, having an entry port and an exit port and provided with external clamping means interconnecting with said mounting flange; a cylindrical piston disposed within the annular cavity defined by the spacer tube, guide bushing and metering cylinder having at one end a T-shaped notch to accommodate the T-shaped connection of the arm; and, means disposed within the annular groove at the junction of the guide bushing to provide a seal between the metering cylinder and the piston.

BRIEF DESCRIPTION OF THE DRAWING

The drawing represents a cross-sectional view of the fill piston and housing assembly of the present invention with the spacer tube and clamp arms being broken.

DETAILED DESCRIPTION OF THE PREFERRED EMBODIMENT

As shown in the drawing, the fill piston and housing assembly of the present invention is a clamped assembly of mating elements. When assembled, the invention is intended to attach to the working means of the conventional filling equipment, which is shown as (10). An arm (12) is secured at one end to the working means of the filling equipment. The opposite end of the arm (12) is provided with a T-shaped connector (14).

A mounting flange (16) is secured directly to the filling equipment, and is provided with a hole through its center to accommodate the arm (12). The mounting flange (16) has a raised section on its opposite face surrounding the hole. This raised section provides a partial groove to accommodate the rim of one end of a hollow cylindrical spacer tube (18) in mating engagement. The partial groove thus created is simpler to machine than a full groove.

At its opposite end, the cylindrical spacer tube (18) meets with a guide bushing (20). A raised circular central section of the guide bushing (20) provides a similar partial groove allowing the spacer tube (18) and the guide bushing (20) to meet in mating engagement.

The guide bushing (20) also has a raised circular central section on its opposite face. This section provides a partial groove to accommodate one end of a metering cylinder (22) in mating engagement. At their point of meeting, however, an annular hollow groove (25) is formed on the inside wall. The metering cylinder (22) is otherwise similar to the conventional art and is provided with a conventional entry and exit port (30) for the dispsensed fluid. The capped port (28) provides separate access for cleaning the sealed metering cylinder (22). At some point along its length the metering cylinder (22) meets with the turret plate (32) of the filling equipment in mating engagement.

The mounting flange (16), spacer tube (18), guide bushing (20) and metering cylinder (22) together from an annular cavity. Disposed within this cavity is a cylindrical piston (24). This piston (24) is provided with a T-shaped slot (15) at one end which accommodates the T-shaped connector (14) of the arm (12) connected to the filling equipment's working means (10). Sealing means (26), such as an O-ring of elastomeric composition, are provided in the annular groove (25), to separate the metering portion of the annular cavity.

External clamping means between the turret plate (32) and the mounting flange (16), here represented by clamp arms (34), external flange (38) and adjusting screws (36), are provided to hold the assembled elements in mating engagement.

The assembly can be used for filling of liquids and semi-liquids. In operation, the material to be filled is drawn into the cylinder through the entry and exit port when the piston is withdrawn and a metered quantity of the material is then discharged through the same port on the forward stroke of the piston. Means (not shown) alternatively connect the entry and exit port with a supply reservoir of material on withdrawal of the piston, and with a receptical to be filled, upon the forward stroke of the piston.

It can be seen from the foregoing description that the improved fill piston and housing assembly of the invention is exceedingly easy to take apart and clean. By loosening the adjusting screws (36) and thereby relieving the clamping pressure, the mating elements are easily removed from the turret plate (32). The piston (24) is then quickly and easily separated from the arm (12) by means of the T-slot connection. The guide bushing, being of one piece construction and also serving as one side of a groove (25) for accommodating an O-ring (24), eliminates the need for an undercut, simplifying machining and eliminating a problem area where bacteria can grow.

What I claim and desire to protect by Letters Patent is:

1. An improved fill piston and housing assembly for attachment to the working means of filling equipment which comprises:

an arm having one end secured to the working means of the filling equipment and having a T-shaped connection at the opposite end;

a mounting flange having one face secured to the filling equipment, having a hole therethrough to accommodate said arm and having a circular raised portion on its opposite face;

a hollow cylindrical spacer tube having one end in mating engagement with the mounting flange and the raised portion thereof;

a guide bushing having one face in mating engagement with the opposite end of the spacer tube and having an opening therethrough;

a metering cylinder in mating engagement with the opposite face of the guide bushing but notched so as to provide an annular groove on the inside surface at their junction, having an entry port and an exit port and provided with external clamping means interconnecting with said mounting flange;

a cylindrical piston disposed within the annular cavity defined by the spacer tube, guide bushing and metering cylinder having at one end a T-shaped notch to accommodate the T-shaped connection of the arm; and means disposed within the annular groove at the junction of the guide bushing to provide a seal between the metering cylinder and the piston.

* * * * *